US006766780B2

(12) United States Patent
Ikuma et al.

(10) Patent No.: US 6,766,780 B2
(45) Date of Patent: Jul. 27, 2004

(54) OUTBOARD MOTOR

(75) Inventors: Tomonori Ikuma, Wako (JP); Masanori Tsubouchi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/367,135

(22) Filed: Feb. 14, 2003

(65) Prior Publication Data

US 2003/0159671 A1 Aug. 28, 2003

(30) Foreign Application Priority Data

Feb. 22, 2002 (JP) ..... 2002-046920

(51) Int. Cl.[7] ..... F02M 35/12
(52) U.S. Cl. ..... 123/184.53
(58) Field of Search ..... 123/184.53, 195 HC, 123/195 P, 184.21, 184.31; 440/88 R, 88 A

(56) References Cited

U.S. PATENT DOCUMENTS 5,476,402 A * 12/1995 Nakai et al. ..... 440/88 R
5,513,606 A * 5/1996 Shibata ..... 123/184.34
5,553,586 A * 9/1996 Koishikawa et al. ..... 123/195 P
5,564,377 A * 10/1996 Azuma ..... 123/184.34
5,596,962 A * 1/1997 Tsunoda et al. ..... 123/184.39
6,125,820 A * 10/2000 Hiraoka ..... 123/336
6,286,472 B1 * 9/2001 Takahashi et al. ..... 123/184.34
6,383,044 B1 * 5/2002 Nemoto et al. ..... 440/77
6,425,360 B1 * 7/2002 Kashima ..... 123/90.31
6,471,559 B2 * 10/2002 Kashima ..... 440/88 R
6,484,685 B2 * 11/2002 Kuroda et al. ..... 123/195 P
6,604,968 B2 * 8/2003 Wada et al. ..... 123/195 P

FOREIGN PATENT DOCUMENTS

JP 08310487 11/1996

* cited by examiner

*Primary Examiner*—Henry C. Yuen
*Assistant Examiner*—J A Benton
(74) *Attorney, Agent, or Firm*—Adams & Wilks

(57) ABSTRACT

An outboard motor having an intake silencing box provided above a cylinder block in communication with combustion chambers is provided. The intake silencing box has left and right air induction passages located forwardly of exhaust passages and extending vertically downwardly between the exhaust passages and a skirt of a crankcase in a suspended fashion. The lower ends of the air induction passages open downwardly.

20 Claims, 5 Drawing Sheets

OUTBOARD MOTOR

FIELD OF THE INVENTION

The present invention relates to an outboard motor having an intake silencing box which constitutes an intake silencer.

BACKGROUND OF THE INVENTION

Outboard motors without intake silencers and outboard motors with their intake openings directed toward the hulls produce intake noises which are transmitted directly to the manipulators and hence are noisy.

Intake silencers are thus provided in intake passages to reduce intake noises. An outboard motor with such a conventional intake silencer is disclosed in, for example, Japanese Patent Laid-Open Publication No. HEI-8-310487.

The conventional intake silencer is disposed in an intake system of an engine of the outboard motor. The intake silencer takes air in from laterally opposite sides of a throttle body provided in a front and laterally generally middle portion within an engine space of the outboard motor. The total cross-sectional area of the two air inlets of the intake silencer is equal to or greater than the cross-sectional area of an intake passage of the throttle body, securing a sufficient amount of intake, reducing the dimension of one air inlet, and thus increasing space efficiency.

The arrangement disclosed in HEI-8-310487 has an air inlet portion located relatively closely to the front part of the engine. In some cases, however, no space is available for the air inlet portion.

SUMMARY OF THE INVENTION

The present invention has been made to solve the above problem and has an object of providing an outboard motor causing no interference between an exhaust passage and an air inlet portion in a portion of the outboard motor other than a portion closer to the front of the engine, regardless of the presence of the exhaust passage at the side of a cylinder head.

It is another object of the present invention to provide an outboard motor with a V-engine in a plan view which can utilize the contour of the V-engine to put an intake silencing box within the opening width dimension of the V shape, securing a sufficient volume of an expansion chamber and a sufficient intake opening of the intake silencing box, preventing increase in the size of the intake silencing box, and increasing noise-reduction efficiency.

It is a particular object of the present invention to provide an outboard motor with an intake silencing box which allows the use of an intake silencing box of a large volume while avoiding increase in the size of the intake silencing box, and allows preferable intake of air into the intake silencing box.

It is another object of the present invention to provide an outboard motor which allows a rational arrangement of an intake silencing box constituting an intake silencer, an alternating-current generator (ACG) and other components.

According to an aspect of the present invention, there is provided an outboard motor having a four-stroke engine, which comprises: a generally vertically extending crankshaft; a cylinder block constituting part of a crankcase housing the crankshaft, the cylinder block having a plurality of generally horizontal cylinders; a cylinder head connected to a rear surface of the cylinder block to form a plurality of combustion chambers; an exhaust passage provided at one side of the cylinder head in communication with the combustion chambers; an intake passage provided at the other side of the cylinder head in communication with the combustion chambers; and an intake silencing box provided above the cylinder block in communication with the combustion chambers via the inlet passage, wherein the intake silencing box has an air induction passage disposed forwardly of the exhaust passage and extending vertically downwardly between the exhaust passage and a skirt portion of a crankshaft space in a suspended fashion, the air induction passage having an air inlet opening downwardly.

Since the air induction passage of the intake silencing box is disposed forwardly of the exhaust passage and extends downwardly between the exhaust passage and the skirt of the crankshaft space in a suspended fashion, interference between an exhaust pipe constituting the exhaust passage and the inlet passage is prevented. It is thus possible to provide an intake silencing box of a large volume while avoiding increase in the lateral size of the outboard motor and reducing the outer size of the outboard motor.

In order to secure a sufficient steering angle especially when two outboard motors are fixed in parallel to the stern, it is required to reduce the lateral dimension of the outboard motors, reducing space in the front of the engines. This invention provides an outboard motor of a small width dimension fulfilling the requirement, requiring less space in the front.

Since the air induction passage of the intake silencing box is extended downward between the exhaust passage and the skirt of the crankshaft space with the inlet opened, the flow of air into the intake silencing box first moves upward from the inlet and then enters the silencing chamber. This prevents water from entering the intake silencing chamber, regardless of the location of an air inlet of an engine cover.

Preferably, the engine comprises a V-engine with the vertically adjacent cylinders forming a rearward-opening V shape as viewed from the top. The cylinders are thus arranged to the shape of angled cylinders of the V-engine, providing a sufficient volume, avoiding increase in the lateral size of the outboard motor, and reducing the size of the outboard motor with the large-volume engine.

According to another aspect of the present invention, there is provided an outboard motor having a four-stroke engine, which comprises: a generally vertically extending crankshaft; right and left cylinder blocks forming part of a crankcase housing the crankshaft, the cylinder block having a plurality of generally horizontal cylinders vertically adjacent to one another and diverging rearwardly into a V-shape in top plan; cylinder heads connected to rear surfaces of the cylinder blocks to form a plurality of combustion chambers; right and left intake passages provided at inner sides of the cylinder heads in communication with the combustion chambers; a generator disposed forwardly of the crankcase; and an intake silencing box provided above the cylinder blocks in communication with the combustion chambers via the intake passages, wherein the intake silencing box has air induction passages disposed forwardly of exhaust passages located at outer sides of the cylinder heads and extending vertically downwardly between the exhaust passages and a skirt of a crankshaft space in a suspended fashion, the air induction passages having inlets opening downwardly.

The outboard motor thus arranged allows the use of an intake silencer most suitable for a 4-stroke V-engine outboard motor of a large volume and a reduced lateral size, allowing the rational arrangement of an intake system, generator and other components.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
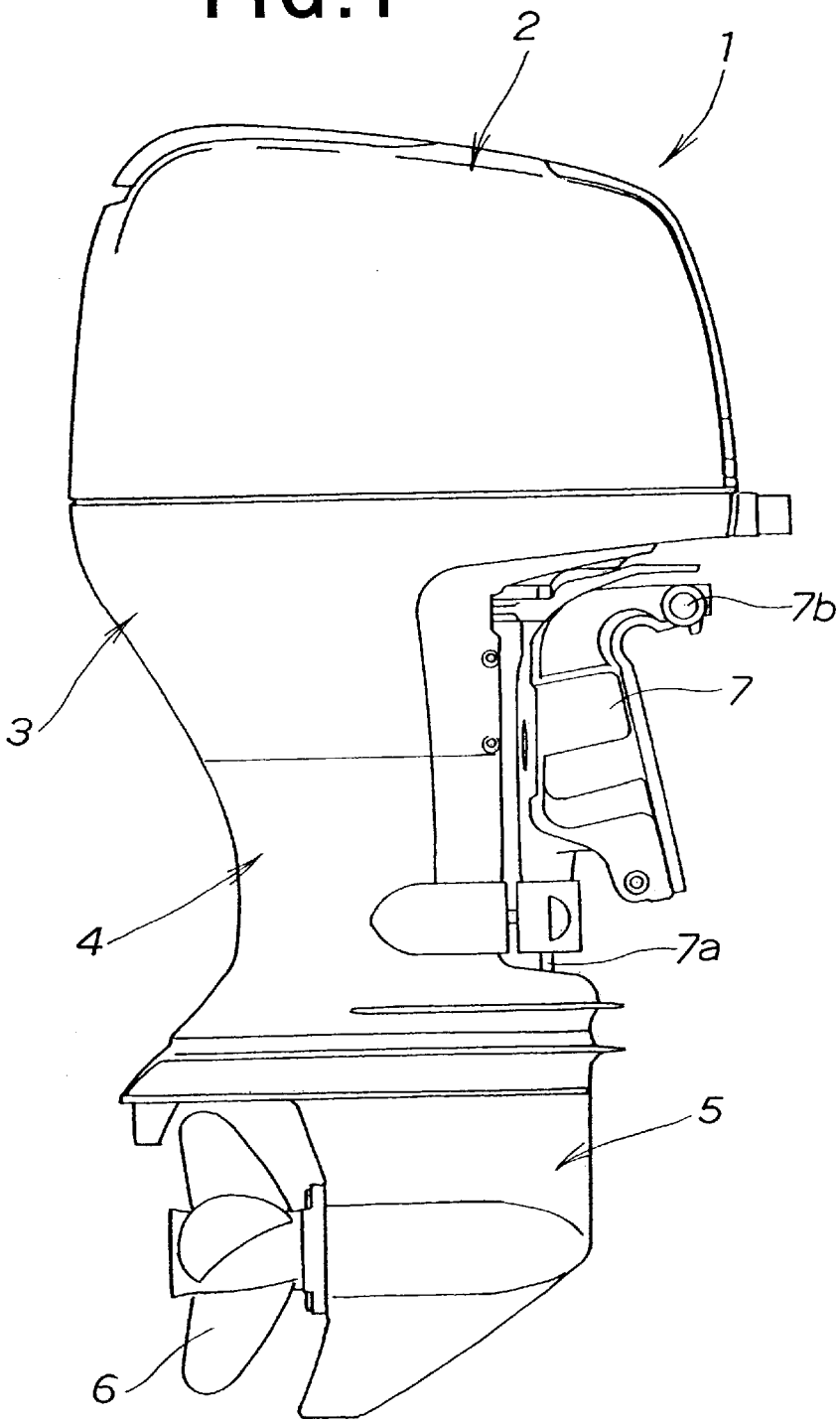
FIG. 1 is a side view of the appearance of an outboard motor according to the present invention.

Referring to FIG. 1, an outboard motor 1 has an uppermost engine cover 2, an undercover 3 disposed below the engine cover 2, an extension case 4 extended vertically below the under cover 3, a gearcase 5 provided below the extension case 4, and a screw 6 oriented rearward. The outboard motor 1 is mounted to a hull of a boat, not shown, via a stern bracket 7. The outboard motor 1 can be moved laterally (for steering) and vertically (upward and downward) via a steering shaft 7*a* and a tilt shaft 7*b*.

Figure 2:
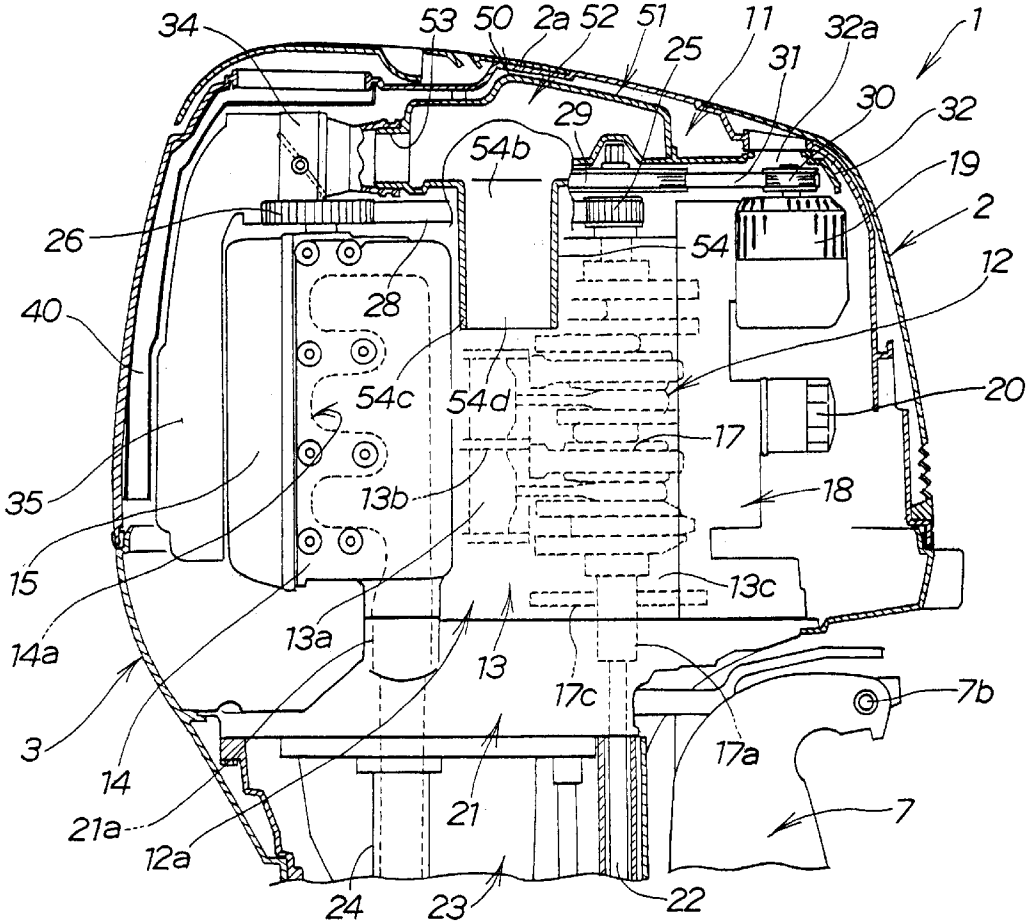
FIG. 2 is a partially cross-sectional side view of an engine, showing an engine cover of the outboard motor shown in FIG. 1 in vertical cross-section.

Reference is now made to FIG. 2 which is a partially cross-sectional side view of an engine with the engine cover of the outboard motor shown in vertical section.

The outboard motor 1 has an engine 12 accommodated in an engine space 11 enclosed by the engine cover 2 constituting the exterior.

Figure 3:
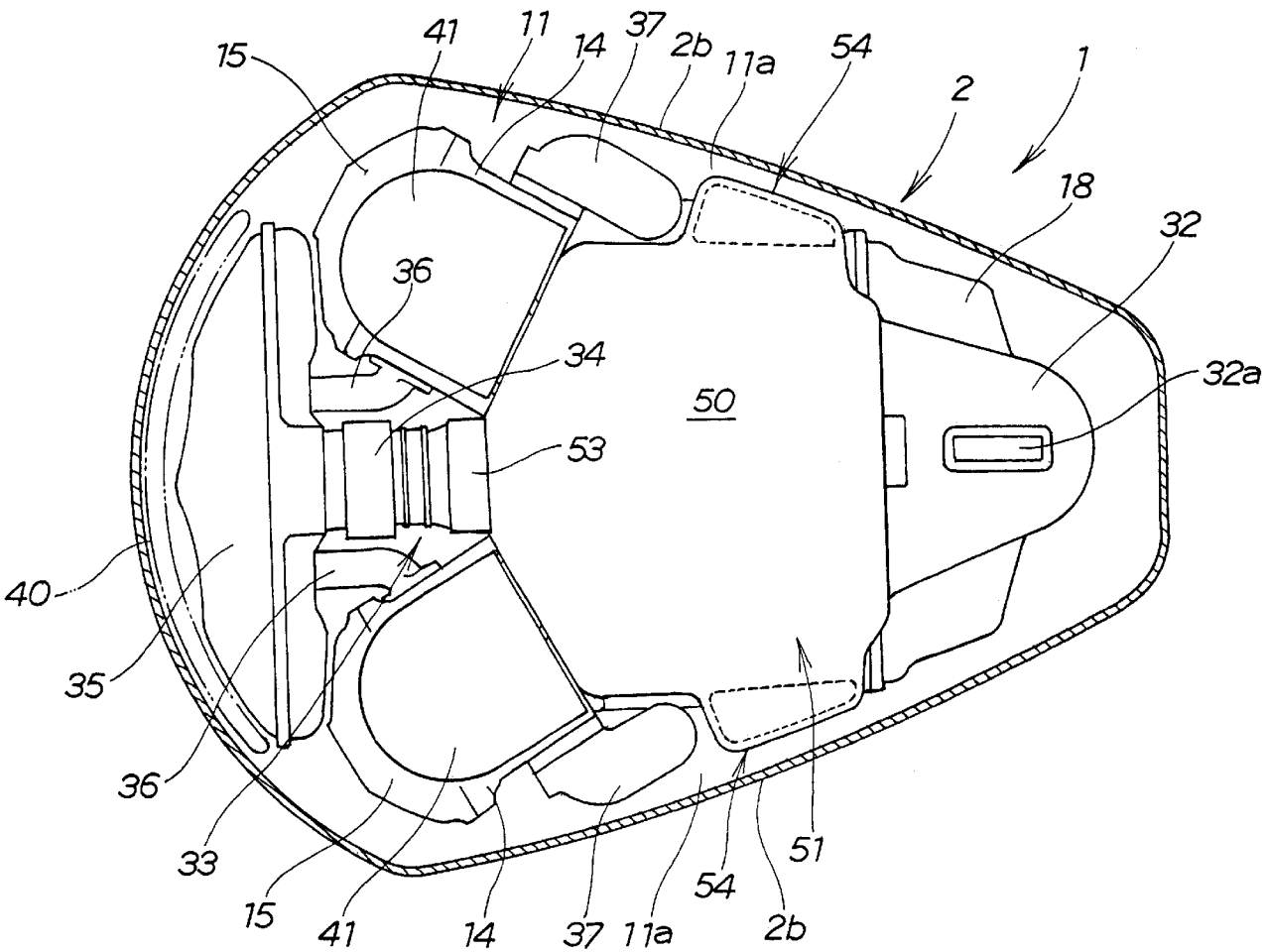
FIG. 3 is a horizontally-cross-sectional plan view of an upper portion of the outboard motor with an upper portion of the engine cover shown in horizontal cross-section.

The engine 12 has a V configuration as viewed in top plan and has diverging right and left cylinder blocks 13, in which a plurality of generally horizontal cylinders 13*b* with a plurality of pistons 13*a* fitted therein are arranged vertically (see FIGS. 2 and 3).

A cylinder head 14 is provided at the rear end of each cylinder block 13 (left in FIG. 2). A cylinder head cover 15 is provided at the rear end of each cylinder head 14.

Each of the left and right cylinder blocks 13, 13 has a plurality of horizontal cylinders 13*b* aligned vertically. Known combustion chambers not shown are formed between the cylinder heads 14, 14 of the cylinders 13*b* and the left and right cylinder blocks 13, 13.

The front of each cylinder block 13 has a front-half portion 13*c* (skirt of the cylinder block) housing a crankshaft 15 disposed in a generally vertical orientation. At the front of the front-half portion 13*c*, a crankcase 18 is provided.

The front-half portion 13*c* and the crankcase 18 form a crankshaft space housing the crankshaft 17 therein.

At a lower portion of the vertically-extending crankshaft 17 is provided a flywheel 17*c* which meshes via its peripheral ring gear with a driven gear of a starter to start the engine 12.

A generator 19 (ACG) is mounted to a front upper end portion of the crankcase 18 located on the right of the front-half portion 13*c* (skirt) of the cylinder block 13 (in a front part of the outboard motor). An oil filter 20 is mounted below the generator 19.

A bottom 12*a* of the engine 12 is supported on a mount case 21 disposed within the undercover 3. A lower end portion 17*a* of the crankshaft 17 extends vertically downward of the mount case 21 and is connected to the upper end of a drive shaft 22 vertically extending through the extension case 4 (see FIG. 1). The lower end of the drive shaft 22 is connected to a gearbox to drive the screw 6 disposed in the gearcase 5 shown in FIG. 1.

In the Figure, reference numeral 23 denotes an oil pan disposed below the mount case 21 located below the bottom 12*a*.

The cylinder head 14 has an exhaust passage 14*a* provided inside. As shown in FIG. 3, left and right exhaust manifolds 37, 37 are extended downward from the sides of the cylinder heads 14, 14. The exhaust manifolds 37, 37 are connected to left and right exhaust pipes 24, 24. The lower end of the exhaust passage 14*a* of the cylinder head 14 is connected for communication to the upper end of an exhaust passage 21*a* extended vertically through the mount case 21. Upper portions of the exhaust pipes 24, 24 substantially vertically extend through the mount case 21 and extend along the laterally opposite sides of the oil pan 23 (because of the locations of the left and right cylinder heads 14, 14 of the V-engine in a plan view). The exhaust pipes 24, 24 extend vertically downward.

Exhaust passages are configured such that downstream portions of the exhaust passages 14*a*, 14*a* within the cylinder heads 14, 14 consist of the exhaust manifolds 37, 37, the exhaust passages 21*a*, 21*a* within the mount case 21 and the exhaust pipes 24, 24, further extending through the extension case 4 and opening into the water.

A top end portion 17*b* (see FIG. 4) of the crankshaft 17 is protruded from the top surface of the front-half portion 13*c* of the cylinder block 13. A camshaft drive pulley 25 (see FIG. 2) is fixed to the top end portion 17*b*. Camshaft driven pulleys 26, 26 are disposed above the left and right cylinder heads 14, 14 arranged on the left in FIG. 2.

Figure 4:
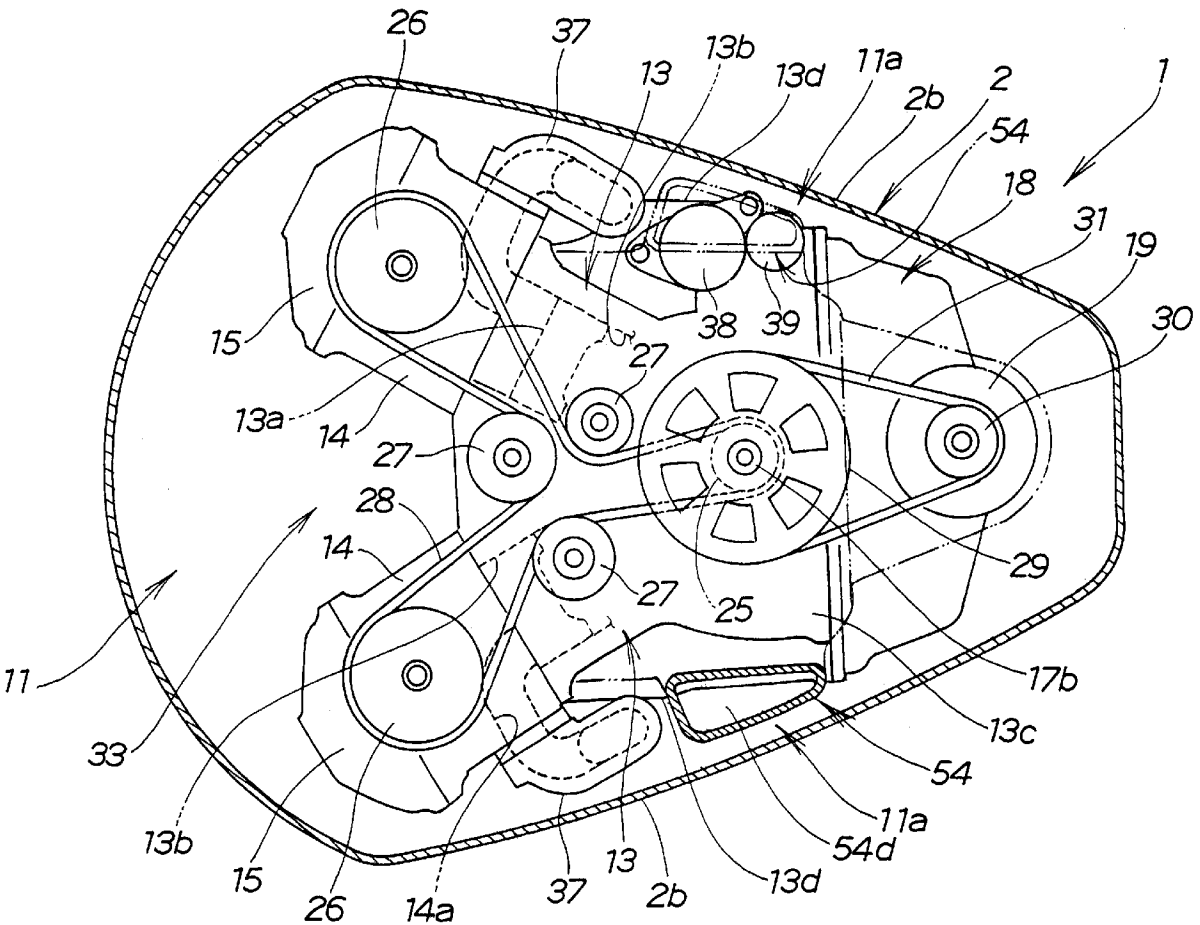
FIG. 4 is a horizontally-cross-sectional plan view with an intake silencing box shown in FIG. 3 removed, showing in cross-section one inlet passage of the intake silencing box and showing the other in imaginary lines.

As shown in FIG. 4, a timing belt 28 is looped around the pulleys 25, 26 and 26 via a plurality of intermediate pulleys 27.

The crankshaft 17 is driven to drive the camshaft via the pulley 25, belt 28 and pulleys 26, 26.

At an upper end portion of the crankshaft 17 above the pulley 25 is provided a coaxial generator drive pulley 29 (see FIG. 4) which is connected via a belt 31 to a generator pulley 30 disposed above the generator 19, to drive the generator 19 with the crankshaft 17. Above the generator pulley 30 is provided a belt cover 32 shown in FIG. 2.

An intake silencing or muffling box 50 constituting part of a fuel supply system is provided in a longitudinally middle portion of the engine space 11 within the engine cover 2, below a top surface 2*a* of the engine cover 2 and above a part of the belt-pulley transmission 25 to 31 located above the cylinder block 13 of the engine 12.

The intake silencing box 50 will be described in detail below with reference to FIGS. 2 to 5.

The intake silencing box 50 has, as shown in FIG. 2, an expansion chamber 52 of a large volume inside a body 51. The body 51 having the expansion chamber 52 inside is shaped like a flat box of a large lateral dimension (in the width direction of the outboard motor) and has a tubular air outlet 53 in a laterally middle portion of the rear end.

The outlet 53 is, as shown in FIG. 3, connected via a grommet or the like to an inlet passage of a throttle body 34 disposed in an area above V-banks 33 of the left and right cylinder heads 14, 14.

The throttle body 34 is connected for communication to an intake manifold 35 disposed rearward of the V-banks 33, extending vertically therebetween to distribute fuel to the combustion chambers via intake pipes or passages 36, 36.

Figure 5:
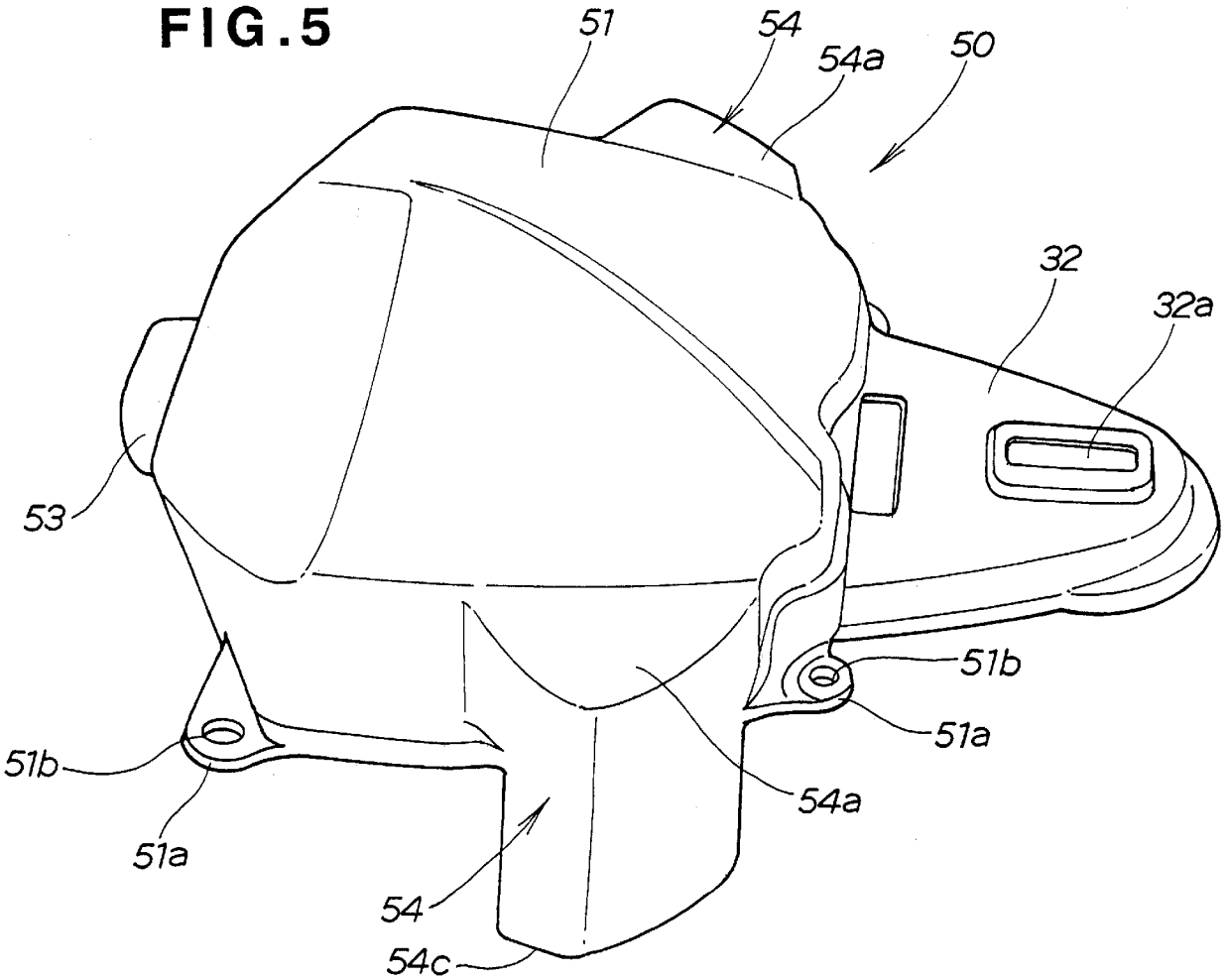
FIG. 5 is a perspective view showing the entire body of the intake silencing box according to the present invention.

The belt cover 32 is mounted to the front end of the body 51 of the intake silencing box 50. An inlet 32*a* for taking cooling air into the engine space 11 is formed in a middle portion of the belt cover 32. As shown in FIG. 5, the body 51 is formed at its four peripheral corners with a plurality of mounting portions 51*a* each having a mounting hole 51*b*. The intake silencing box 50 is mounted on the top surface of the cylinder block 13 via the mounting portions 51*a*.

As shown in FIGS. 4 and 5, air induction passages 54, 54 as tubular passages for taking air in are provided at the laterally opposite sides of the body 51 of the intake silencing box 50. The air induction passages 54, 54 each have an upper end portion 54*a* which communicates as an inner downstream passage portion 54*b* (see FIG. 2) with the expansion chamber 52.

The air induction passages 54, 54 are located outward of the left and right side walls of the body 51. The top end portions 54*a*, 54*a* are bent at right angles downward with respect to the body 51 and extended vertically downward at a predetermined length from the opposite outer sides of the body 51. Lower end portions 54*c* thereof are formed with inlets 54*d*, 54*d* for taking air in. The inlets 54*d*, 54*d* open downward (see FIG. 2). The inlet passages 54, 54 are oriented downward in left and right side spaces 11*a*, 11*a* within the engine space 11, outside the laterally opposite outer sides of the cylinder block 13 and inside two sides 2*b*, 2*b* (see FIG. 3) of the engine cover 2.

As shown in FIGS. 3 and 4, the exhaust pipes 24, 24 are connected to downstream portions of the exhaust manifolds 37, 37 which are connected to the exhaust passages of the left and right cylinder heads 14, 14. The exhaust manifolds 37, 37 thus constitute upstream portions of the exhaust passages.

The upstream exhaust passages including the exhaust manifolds 37, 37 are located in the side spaces 11*a*, 11*a* within the engine space 11, rearward of the air induction passages 54, 54 provided at the opposite sides of the body 51 of the intake silencing box 50. The air induction passages 54, 54 of the intake silencing box 50 are thus located forward of the exhaust passages.

The air induction passages 54, 54 are located forward of the exhaust pipes 24, 24 at the opposite outer sides of the body 51 of the intake silencing box 50 disposed on the top surface of the cylinder block 13, being extended vertically downward from an upper portion of the cylinder block 13 to its middle portion on the opposite sides of the cylinder block 13.

The engine 12 is narrower in width at its upper portion located above a vertically-middle portion of the cylinder block 13 than its lower portion. The lower portion provides wide portions 13*d*, 13*d*. The cylinder block 13 is fixed at the lower ends of the wide portions 13*d*, 13*d* onto the mount case 21. A hollowed area proximately above one wide portion 13*d* is used to dispose a starter motor 38 and a starter relay 39.

An intake guide 40 shown in FIGS. 2 and 3 introduces air into the engine cover 2.

Belt covers 41, 41 shown in FIG. 3 cover the camshaft pulleys 26, 26 and the belt 28 disposed above the left and-right cylinder heads 14, 14.

The present disclosure relates to the subject matter of Japanese Patent Application No. 2002-046920, filed Feb. 22, 2002, the disclosure of which is incorporated herein by reference in its entirety.

What is claimed is:

1. An outboard motor having a four-stroke engine, comprising:

a generally vertically extending crankshaft;

at least one cylinder block and a skirt constituting a crankcase for housing the crankshaft, the cylinder block having a plurality of generally horizontal cylinders;

a cylinder head connected to a rear surface of the cylinder block opposite the skirt to form a plurality of combustion chambers in the cylinders;

an exhaust passage provided at one side of the cylinder head in communication with the combustion chambers;

an intake passage provided at another side of the cylinder head in communication with the combustion chambers; and an intake silencing box provided above the cylinder block in communication with the combustion chambers via the intake passage, the intake silencing box having an air induction passage disposed forward of the exhaust passage and extending vertically downwardly between the exhaust passage and the skirt of the crankcase in a suspended fashion, the air induction passage having an air inlet opening downwardly.

2. An outboard motor according to claim 1; wherein the engine comprises a V-engine with the cylinders arranged vertically adjacent to each other, and the at least one cylinder block comprises a pair of cylinder blocks diverging rearwardly into a V shape as viewed in top plan.

3. An outboard motor with a four-stroke engine, comprising:

a generally vertically extending crankshaft;

right and left cylinder blocks and a skirt forming a crankcase for housing the crankshaft, the cylinder block having a plurality of generally horizontal cylinders vertically adjacent to one another and diverging rearwardly into a V shape as viewed in top plan;

cylinder heads connected to rear surfaces of the cylinder blocks to form a plurality of combustion chambers in the cylinders;

right and left intake passages provided at inner sides of the cylinder heads in communication with the combustion chambers;

a generator disposed forwardly of the crankcase; and an intake silencing box provided above the cylinder blocks in communication with the combustion chambers via the intake passages, the intake silencing box having air induction passages disposed forwardly of exhaust passages located at outer sides of the cylinder heads and extending vertically downwardly between the exhaust passages and the skirt of the crankcase in a suspended fashion, the air induction passages having inlets opening downwardly.

4. An outboard motor according to claim 1; further comprising a throttle body disposed above the cylinder block rearward of the intake silencing box and having an inlet in communication with an outlet of the intake silencing box and an outlet in communication with the intake passage.

5. An outboard motor according to claim 4; further comprising a grommet for connecting the outlet of the intake silencing box to the inlet of the throttle body.

6. An outboard motor according to claim 1; wherein the intake silencing box has a body with a substantially flat top wall.

7. An outboard motor according to claim 1; further comprising a transmission system for transmitting a drive force from the crankshaft to a camshaft disposed in the cylinder head and to a generator disposed above the cylinder block, the transmission system being provided between the cylinder block and the intake silencing box.

8. An outboard motor according to claim 7; wherein the transmission system comprises a drive pulley mounted to an upper end portion of the crankshaft, a generator having a first driven pulley connected in driven relation to the drive pulley via a first endless belt extending around the drive pulley and the first driven pulley, a second driven pulley mounted to an upper end portion of the camshaft and connected in driven relation to the drive pulley via a second endless belt extending around the drive pulley and the second driven pulley, and a belt cover covering the drive pulley, the first driven pulley and the endless belt.

9. An engine comprising: a crankshaft; an engine block defining a crankcase for housing the crankshaft and a plurality of cylinders extending generally orthogonally to the crankshaft; at least one cylinder head connected to the engine block to form a plurality of combustion chambers in the cylinders; at least one exhaust passage provided adjacent to the at least one cylinder head in communication with the combustion chambers; at least one intake passage provided adjacent the at least one cylinder head and in communication with the combustion chambers; and an intake silencer provided above the engine block in communication with the combustion chambers via the at least one intake passage, the intake silencer having at least one air introduction passage each with an air inlet disposed forward of the at least one exhaust passage and extending vertically downwardly between the at least one exhaust passage and the crankcase in a suspended fashion.

10. An engine according to claim 9; wherein the engine block has a V-shape with vertically adjacent cylinders diverging rearwardly into a V shape to define a pair of cylinder blocks, and the at least one cylinder head comprises a cylinder head connected to each of the cylinder blocks.

11. An engine according to claim 10; wherein the at least one exhaust passage comprises a pair of exhaust passages provided at a first side of each of the cylinder heads.

12. An engine according to claim 11; wherein the at least one intake passage comprises a pair of intake passages provided at a second side of each of the cylinder heads.

13. An outboard motor according to claim 12; wherein the at least one air introduction passage comprises a pair of air introduction passages provided at opposite lateral sides of the intake silencer and extending downwardly along the second side of each cylinder head.

14. An engine according to claim 13; further comprising a throttle body interposed between the intake silencer and the combustion chambers.

15. An engine according to claim 14; wherein the throttle body is provided above the engine block behind the intake silencer and has an inlet facing the intake silencer and an outlet in communication with the pair of air intake passages; and the intake silencer has an outlet provided between the air introduction passages above the cylinder blocks and connected to the inlet of the throttle body.

16. An engine according to claim 15; wherein the intake silencer has a main body with a volume increasing in the diverging direction of the cylinder blocks, and the air introduction passages are disposed on opposite sides of the main body and extend downward at right angles to the main body.

17. An engine according to claim 16; further comprising a generator disposed forward of the crankcase.

18. An engine according to claim 17; further comprising a transmission system for transmitting a drive force from the crankshaft to a camshaft disposed in each of the cylinder heads, the transmission system being provided between the engine block and the intake silencer.

19. An outboard motor according to claim 18; wherein the transmission system comprises a drive pulley mounted to an upper end portion of the crankshaft, a first driven pulley provided on the generator and connected in driven relation to the drive pulley via a first endless belt extending around the drive pulley and the first driven pulley, second driven pulleys provided on each of the camshafts and connected in driven relation to the drive pulley via a second endless belt extending around the drive pulley and the second driven pulleys, and a belt cover covering the drive pulley, the first driven pulley, the first endless belt, and at least an upper portion of the generator, the belt cover having a vent hole.

20. An engine according to claim 19; further comprising a housing having an engine compartment in which the engine is disposed and a mounting bracket for attachment to a boat; a drive shaft connected to the crankshaft and extending vertically downward therefrom; and a gearcase for converting a direction of rotational motion of the drive shaft for driving screw extending rearward of the gearcase for propelling the boat.

* * * * *